United States Patent [19]

Graf

[11] 4,383,557

[45] May 17, 1983

[54] WEAVING HEDDLE

[75] Inventor: Martin Graf, Horgenberg, Switzerland

[73] Assignee: Grob & Co. Aktiengesellschaft, Horgen, Switzerland

[21] Appl. No.: 238,977

[22] Filed: Feb. 27, 1981

[30] Foreign Application Priority Data

Mar. 5, 1980 [CH] Switzerland ..... 1730/80

[51] Int. Cl.[3] ..... D03C 9/02

[52] U.S. Cl. ..... 139/93; 139/96

[58] Field of Search ..... 139/92, 93, 94, 95, 139/96

[56] References Cited

U.S. PATENT DOCUMENTS

| | | | |
|---|---|---|---|
| 1,545,904 | 7/1925 | Kaufmann | 139/92 |
| 2,737,982 | 3/1956 | Muller | 139/96 |
| 3,417,789 | 12/1968 | Graf | 139/96 |
| 4,155,379 | 5/1979 | Graf | 139/96 |

FOREIGN PATENT DOCUMENTS

| | | | |
|---|---|---|---|
| 1147900 | 4/1963 | Fed. Rep. of Germany | 139/96 |

*Primary Examiner*—Henry Jaudon

*Attorney, Agent, or Firm*—Watson, Cole, Grindle & Watson

[57] ABSTRACT

A weaving heddle comprises a strip of material of constant cross-section throughout its entire length, and has open end loops of plastic material molded in place on oposed end sections of the strip. A central section of the strip between the end sections has a centrally located thread eye. The end loops have bearing surfaces for engaging heddle carrying rods of a heddle frame, such surfaces lying along a common axis. This central section of the strip is bent and offset from such axis in the same lateral direction in which the end loops extend from their end sections.

Such a bent heddle may be utilized with an unbent heddle so as to form a heddle pair having two thread eyes. This other heddle comprises a straight strip of material of constant cross-section throughout its entire length, with open end loops, corresponding in shape and size to the end loops on the bent heddle, being attached to opposed end sections. A central section of the unbent heddle contains a centrally located thread eye, and the thread eyes of both heddles are offset equal distances from and lie on opposite sides of the aforementioned axis.

1 Claim, 2 Drawing Figures

WEAVING HEDDLE

BACKGROUND OF THE INVENTION

This invention relates generally to a weaving heddle having laterally open end loops and a thread eye in a central section of the heddle.

Known weaving heddles of this general type have the thread eye offset from the axis which extends through the longitudinal center of both end loops, i.e., through the bearing surfaces of the loops which engage the heddle carrying rods of a heddle frame. Heddles of this type can be used for a so-called DUPLEX application with two rows of thread eyes. The strip of material used for the manufacture of the prior art heddle is blanked out laterally along the length of the central section between both end loops so that only one edge of the original strip of material will define the side edge of this section. For stronger and hook-shaped end loops the entire original width of the strip of material must necessarily be used. Due to this lateral blanking away of material, the thread eye in this, now narrower, central heddle section is offset from the axis extending through the bearing surfaces of the end loops. In order to achieve the DUPLEX thread eye arrangement, i.e., two parallel rows of thread eyes, the heddles are aligned in such a manner that those having a machined edge on the left side will alternate with those having a machined edge on the right side. However, since the manufacture of these heddles involves not only a blanking out operation but subsequent careful polishing, production is relatively complex and expensive.

SUMMARY OF THE INVENTION

It is therefore an object of the present invention to provide a weaving heddle of the aforementioned type but which can be produced in a more simple and economical manner. The heddle according to the invention is produced from an elongated strip of material of constant cross-section throughout the entire length thereof. Open end loops are attached to end sections of the strip and extend laterally therefrom in one direction. The end loops have bearing surfaces for engaging heddle carrying rods of the heddle frame, and these bearing surfaces lie along a common axis. A central section of the strip of material between the end sections is bent and offset from this common axis in the one direction.

Preferably, the strip of material is of steel and has a constant width over its entire length, the end loops preferably being of plastic material and molded onto the end sections of the steel strip.

Further according to the invention, a heddle pair is provided having two thread eyes. Thus, the heddle having a bent central section as aforedescribed is superimposed over another heddle made of an elongated strip of material of constant cross-section throughout its entire length and having attached open end loops at its end sections which overlap with the open end loops of the bent heddle. The central sections of both heddles with their thread eyes are parallel to and lie on opposite sides of the aforementioned axis extending through the centers of the end loops. A heddle pair of this type not only better withstands bending compared to prior art heddle pairs, but avoids the need for further machining to remove material therefrom. Moreover, a straight strip of material can be used for the unbent heddle which requires no further shape-changing machinging whatsoever. And, with its molded on end loops, preferably of plastic material, a heddle is provided in which its thread eye is offset from the common axis extending through the bearing surfaces of the end loops, on a side thereof opposite the side of the axis on which the central section of the bent heddle lies, both thread eyes being offset equal distances.

Provision of a heddle pair with two thread eyes according to the invention also has a distinct advantage in their application on weaving machines with hydraulic weft insertion, because with the higher density resulting from this double-rowed arrangement of heddles, the water used for the hydraulic weft insertion will tend to adhere less to the heddles. Water adhering to the heddles hinders the flow of warp resulting in automatic stoppages of the weaving machine or the occurence of warp breakages. Finally, the provision of plastic end loops avoids damage to the heddles through corrosion and rust.

Other objects, advantages and novel features of the invention will become more apparent from the following detailed description of the invention when taken in conjunction with the accompanying drawings.

DETAILED DESCRIPTION OF THE INVENTION

Figure 1:
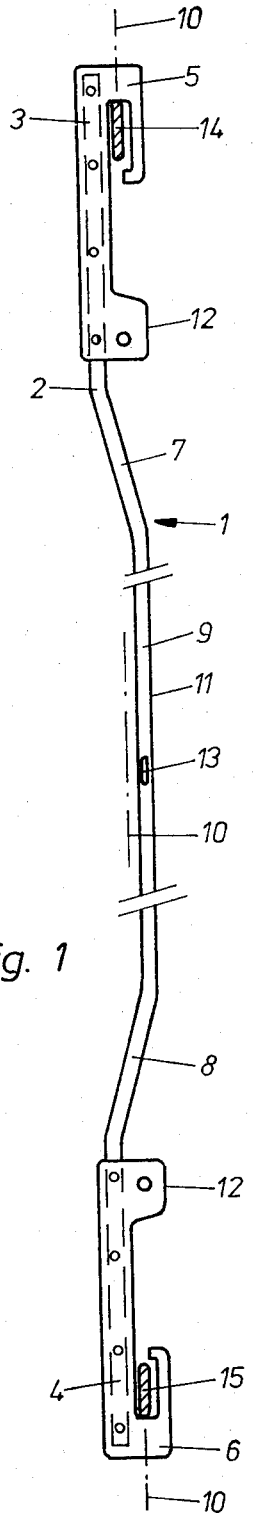
FIG. 1 is a side elevational view of a heddle according to the invention having a bent central section.

Turning now to the drawings wherein like reference characters refer to like in the corresponding parts throughout the several views, a weaving heddle 1, shown in FIG. 1, comprises an elongated strip of material 2 having a constant cross-section throughout the entire length thereof. The strip has opposed end sections 3 and 4 with open end loops 5 and 6 respectively attached thereto. These end loops, preferably of plastic material, are injection molded in place onto the end sections, and extend laterally therefrom in one direction (e.g., to the right shown in FIG. 1).

Strip 2 also has a central section lying between the end sections, this central section including bends 7 and 8 adjacent the respective end loops as well as a straight section 9 between the bends. The straight section has a thread eye 13 therein extending lengthwise at its center. A common axis 10 extends through the center of the two end loops at the open sides thereof. The situs of this common axis is established by bearing surfaces of the end loops which engage heddle carrying rods 14 and 15 of a heddle frame (not shown) as in the customary manner. These bearing surfaces lie along axis 10. And, straight section 9 of the heddle lies parallel to axis 10 and is offset from this axis in the aforementioned one direction so as to lie to the right of axis 10 when viewing FIG. 1. The distance of an outer longitudinal edge 11 of this bent heddle section 7, 8, 9 from axis 10 is less than or at the most equal to the distance between outer edges 12 of the end loops and axis 10. The extent of this lateral displacement is determined by the width of the heddle frame (not shown). With the spacing between edge 11 and axis 10 being no greater than the distance between outer edges 12 and axis 10, heddles of one heddle frame are prevented from hitting against heddles of an adjacent heddle frame.

Strip 2 of material is preferably of steel which is bent as at 7 and 8 and in which thread eye 13 is provided in any normal manner, the steel strip necessating no further machining.

Figure 2:
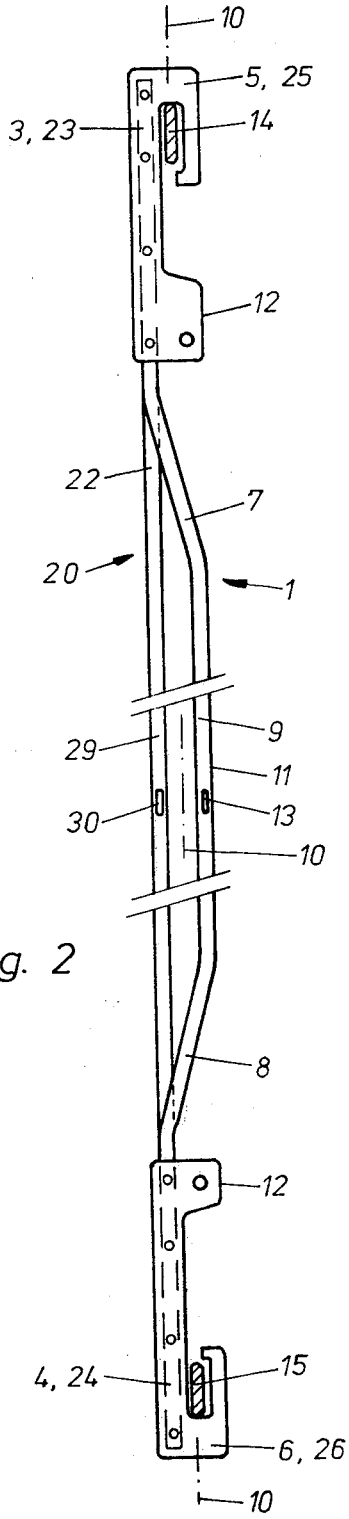
FIG. 2 is a side elevational view of a heddle pair according to the invention with the bent heddle of FIG. 1 superimposed over a straight heddle thereby resulting in a heddle pair having a pair of offset thread eyes.

The heddle of FIG. 1 according to the invention may be utilized as a heddle pair together with another heddle 20 over which heddle 1 is superimposed so that their respective end loops overlap. Heddle 20 comprises a straight strip 22 of steel having a constant cross-section throughout the entire length thereof, and having end sections 23 and 24 with end loops 25 and 26 respectively attached thereto. As in heddle 1, these end loops are preferably of plastic material and correspond in shape to end loops 5 and 6. And, heddle 20 has a central section 29 between its end sections, a longitudinally extending thread eye 30 being centrally located therein. After end loops 25 and 26 are molded in place on the end sections of heddle 20, axis 10 will automatically lie to the right (when viewing FIG. 2) of the straight central section of heddle 20 since the end loops extend laterally in this same direction as end loops 5 and 6, axis 10 extending through the bearing surfaces of both pairs of superimposed end loops. Thus, the central sections of heddles 1 and 20 lie parallel to axis 10 and are offset equal distances (together with their thread eyes 13 and 30) from opposite sides of axis 10. Thus, a heddle pair having two thread eyes is effected by simply bending one of the heddles. The thread eyes are opposite each other, lie in the same horizontal plane and lie at equal distances from axis 10.

Obviously, many modifications and variations of the present invention are made possible in the light of the above teachings. It is therefore to be understood that within the scope of the appended claims the invention may be practiced otherwise than as specifically described.

What is claimed is:

1. A heddle pair having two thread eyes, comprising elongated first and second strips of material of constant cross-section throughout the entire length thereof, said strips each having opposed end sections and central sections between said end sections, said central sections respectively containing said thread eyes which lie in the same horizontal plane, open end loops attached to said end sections of said strips and respectively overlapping, said end loops extending laterally from said strips in one direction and having bearing surfaces for engaging heddle carrying rods of a heddle frame, said bearing surfaces lying along a common axis, said central section of said first strip being bent and offset from said axis in said one direction, said second strip being straight with said central section thereof offset from said axis in a direction opposite said one direction, and said central sections lying parallel to said axis.

* * * * *